US005213365A

United States Patent [19]

Föhl

[11] Patent Number: 5,213,365

[45] Date of Patent: May 25, 1993

[54] INERTIALLY LOCKING BUCKLE FOR SEAT PRETENSIONER

[75] Inventor: Artur Föhl, Schorndorf, Fed. Rep. of Germany

[73] Assignee: TRW Repa GmbH, Alfdorf, Fed. Rep. of Germany

[21] Appl. No.: 790,375

[22] Filed: Nov. 12, 1991

[30] Foreign Application Priority Data

Nov. 15, 1990 [EP] European Pat. Off. ..... 90121893.3

[51] Int. Cl.[5] ..... B60R 22/34

[52] U.S. Cl. ..... 280/806; 24/642; 24/633; 297/480

[58] Field of Search ..... 24/642, 633; 280/801, 280/805, 806, 807, 808; 297/468, 480, 483

[56] References Cited

U.S. PATENT DOCUMENTS 5,008,989 4/1991 Wedler et al. ..... 24/633
5,054,171 10/1991 Tanaka ..... 24/633
5,066,042 11/1991 Föhl ..... 297/480
5,097,571 3/1992 Föhl ..... 24/633

FOREIGN PATENT DOCUMENTS 3533684 2/1987 Fed. Rep. of Germany ..... 24/633
1589059 5/1981 United Kingdom ..... 24/642
WO88/06012 8/1988 World Int. Prop. O. ..... 24/633

*Primary Examiner*—Karin L. Tyson
*Attorney, Agent, or Firm*—Tarolli, Sundheim & Covell

[57] ABSTRACT

In a buckle for safety belt systems in vehicles which are provided with a belt pretensioner acting on the bucket an unintentional release of the insert tongue is prevented by a two-armed lever which is pivotally mounted on the loadbearing housing. On each actuation of the release button the lever is pivoted out of its rest position into a deflected position. At the end of a pretensioning stroke one of the arms of the lever projects into the path of movement of the release button to prevent the further movement thereof in the actuating direction.

18 Claims, 4 Drawing Sheets

Fig.7A
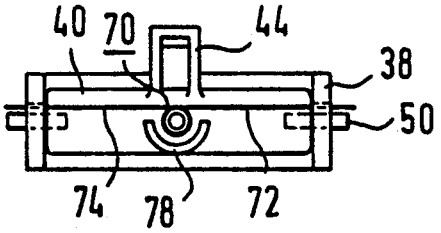
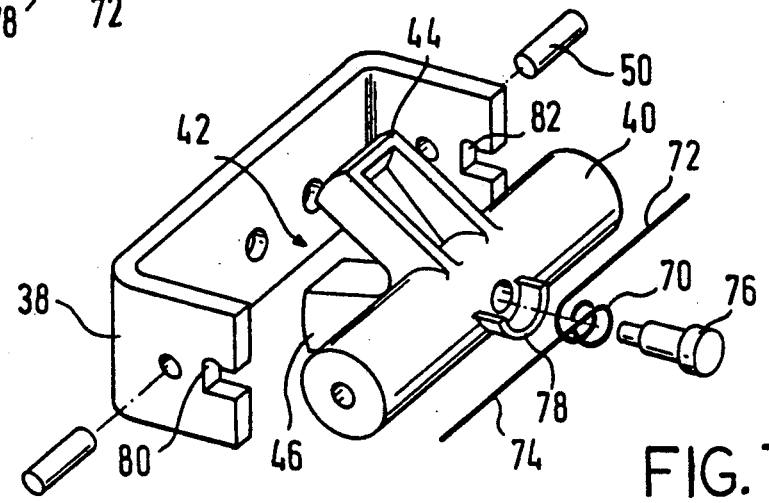
FIG.7B
Fig. 8A
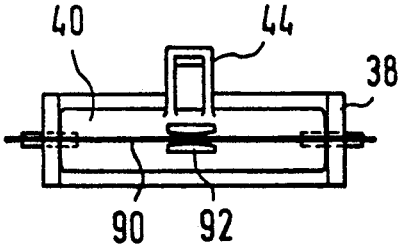
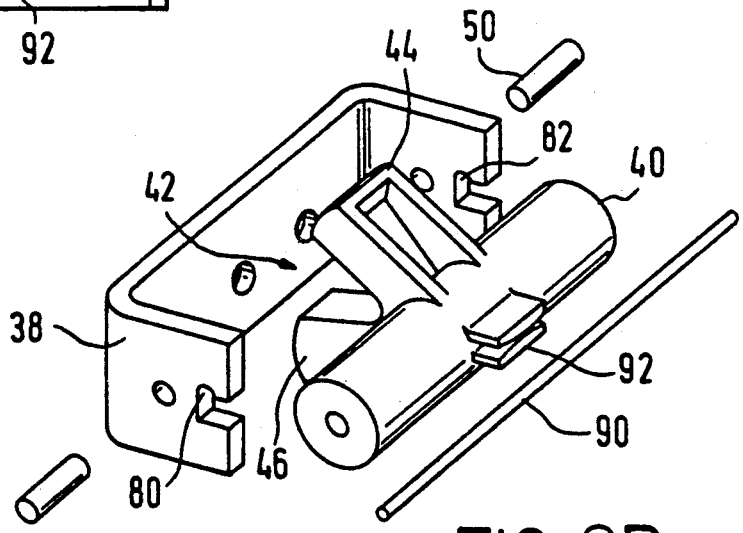
FIG.8B

INERTIALLY LOCKING BUCKLE FOR SEAT PRETENSIONER

The invention relates to a buckle for safety belt systems in vehicles which are provided with a belt pretensioner engaging on the buckle to move the buckle downwardly towards the vehicle floor along a predetermined stroke to tighten the belt webbing. The buckle has a loadbearing housing in which an insert path for an insert tongue is formed. A locking bar engages the insert tongue and is movable between a first position in which the insert tongue is blocked in the buckle and a second position in which the insert tongue is released from the buckle. A release button is biased by spring force into a rest position. Actuation of the release button in the direction of the insert movement of the insert tongue, corresponding to the moving direction of the buckle in a pretensioning stroke, moves the locking bar into the second position to release the insert tongue from the buckle.

BACKGROUND OF THE INVENTION

Buckles for safety belt systems are known in numerous constructions. A design has proved itself in which an insert path for the insert tongue is formed in the loadbearing housing of the buckle. The locking bar which is displaceably guided or pivotally mounted on the housing transversely of the insert path cooperates with a detent opening of the insert tongue. A blocking member guided displaceably parallel to the insert path in the housing holds the locking bar in its locking position as long as a release button likewise guided displaceably parallel to the insert path in the housing is in its rest position. This release button is connected to the blocking member for moving the latter on actuation into a release position in which the locking bar comes free of the detent opening of the insert tongue.

The use of such a buckle in safety belt systems having a belt pretensioner is not problematical when the pretensioner force engages for example the spool of the belt retractor. Belt pretensioners have also been proposed which act between the buckle and its attachment point on the vehicle body or a vehicle seat. Such pretensioners shorten the distance between the attachment point of the buckle and, the buckle itself by a few centimeters, for example 10 centimeters, by moving the buckle towards its attachment point on the vehicle. The pretensioners used in such cases have a mechanic drive with a force accumulator in the form of a tensioned spring which is released by a sensor responsive to inertia forces and effects a belt tightening operation when required.

The force required for the tightening of the belt can be generated mechanically by means of a strongly dimensioned spring or pyrotechnically. If the tightening force is of adequate magnitude, in particular when using pyrotechnical pretensioners, in certain cases when using a buckle of the type set forth above, an unintentional release of the insert tongue from the buckle can occur at the end of the pretensioning stroke.

This unintentional release of the insert tongue is due to the mass inertia of the release button and any components engaging thereon because the release button tends at the end of the pretensioning stroke to continue its movement in the direction of the stroke, which corresponds to the actuating direction of the release button. It has therefore already been proposed to prevent this continued movement of the release button under the influence of inertial forces by using compensating masses or blocking pawls. With moderate tightening forces as generated by mechanical pretensioners such solutions are perfectly practicable. However, with the extremely high tightening forces which can be generated by pyrotechnical pretensioners all the known solutions prove to be useless because either they respond too slowly and thus cannot prevent an unintentional release of the insert tongue or they do not stand up to the extreme mechanical stresses.

If the buckle is provided with a pawl which at the end of the pretensioning stroke becomes active through mass inertia to prevent the movement of the release button in the actuating direction, then said pawl represents a constructional component which will never become active during the life of the buckle. It is only during a pretensioning operation, which possibly might not occur until the buckle has been used for ten years, that the pawl must move out of a rest position under its mass inertia into a locking position. In its rest position it is generally held by a spring. Now, there is no excluding the possibility that in the course of the long use period of the lock impairments of the functionability of the pawl occur. For example, by soiling or penetration of extraneous particles it can be prevented from moving out of its rest position into its blocking position.

SUMMARY OF THE INVENTION

The present invention makes available a buckle for safety belt systems in vehicles which on each actuation of the release button ensures a movement of a two-armed lever, which in a pretensioning operation is able to block the release button, from its rest position into a deflected position in which the release button imparts a constrained movement to said lever. By this constrained movement of the lever on each actuation of the release button the freedom of movement thereof is ensured even over long periods of time of ten or more years.

According to the invention, the buckle has a pivotally mounted two-armed lever which is biased by at least one spring into a rest position. The first arm of the lever in the rest position thereof is disposed adjacent the movement path of the release button spaced from the latter. The second arm of the lever projects into the movement path of the release button so that before reaching the end of its movement path the release button meets the second arm of the lever and pivots the latter against the spring bias into an end position. The first arm of the lever then enters into a recess of the release button. The center of gravity of the two-armed lever relatively to its pivot axis is so chosen that the lever under the action of the intertial forces engaging thereon at the end of the pretensioning stroke is pivoted against the spring bias out of its rest position before the release button has moved out of its rest position due to the inertial forces acting thereon. The first arm of the lever after the pivoting thereof out of its rest position projects into the movement path of the release button and prevents the movement thereof in the actuating direction.

Due to the regular constrained movement of the lever on each actuation of the release button, the buckle according to the invention is distinguished by an extremely high functional reliability during a pretensioner operation. Furthermore, the arrangement of the lever relatively to the release button provides a mechanically highly stressable abutment for the release button so that constructions are also possible in which under certain circumstances further masses are coupled to the release button, in particular the insert tongue, which under unfavourable circumstances can additionally press onto the release button.

BRIEF DESCRIPTION OF THE DRAWINGS

A preferred embodiment of the invention will now be described in detail with reference to the drawings, wherein:

FIG. 7A shows a perspective view of a constructional variant of the mounting of the lever;

FIG. 7B is an exploded view of the lever of FIG. 7A:

FIG. 8A shows a perspective view of a further constructional variant of the mounting of the two armed lever; and FIG. 8B is an exploded view of the lever of FIG. 8A.

DESCRIPTION OF A PREFERRED EMBODIMENT

Figure 1:
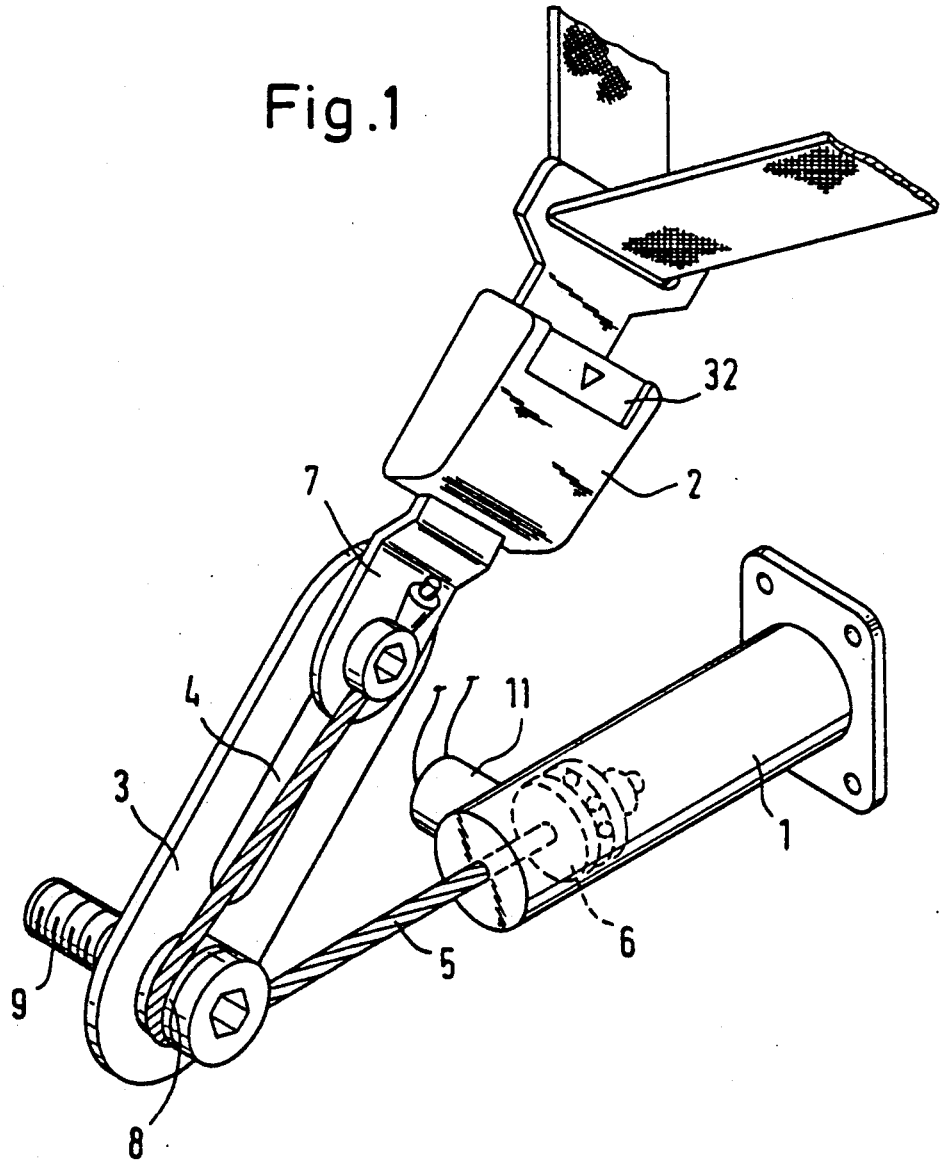
FIG. 1 shows a safety belt system in a vehicle equipped with a belt pretensioner engaging on the buckle.

The belt pretensioner shown in FIG. 1 consists of a pyrotechnical piston/cylinder pretensioning drive 1 of which the cylinder is anchored to the vehicle bodywork, a longitudinal guide for the buckle 2 in the form of an elongated anchoring plate 3 provided with a slot 4, a pulling cable 5 connecting the piston 6 to the securing fitting 7 of the buckle and a deflection pulley 8 via which the pulling cable 5 is guided and which is mounted on a mounting pin 9 by means of which the anchoring plate 3 is secured to the vehicle bodywork.

FIG. 1 shows the belt pretensioner in the non-activated state. An end face of the piston 6 can be subjected to pressurized gases which are generated by a pyrotechnical gas generator 11. Under the action of the pressurized gases the piston 6 is driven with extremely high acceleration and via the pulling cable 5 and the securing fitting 7 draws the buckle 2 downwardly. At the lower end of the slot 4 the movement of the buckle 2 is suddenly stopped. By a return blocking means integrated into the piston 6 the buckle 2 is prevented from being able to move in the direction of its initial position after an effected pretensioning.

When at the end of the pretensioning stroke the buckle 2 is suddenly stopped, at the release button 32 and the parts connected thereto high inertia forces occur which are directed in the direction of the release movement of the release button.

Figure 2:
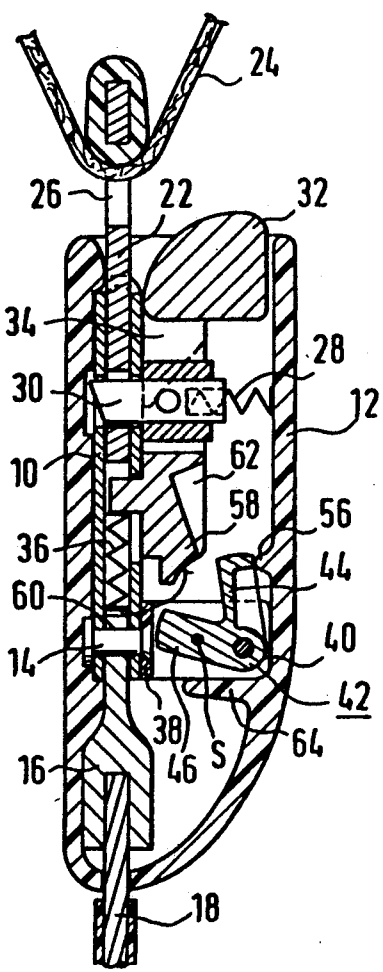
FIG. 2 shows a longitudinal section of the buckle according to the invention with the insert tongue inserted and locked

A loadbearing housing 10 (FIG. 2) of the buckle is surrounded by a cover shell 12 of plastic. The housing 10 is connected by a rivet 14 to a fitting 16 in which an anchoring cable 18 for securing the buckle to a vehicle seat or to the vehicle floor is pressed clamped. The loadbearing housing 10 is formed by a generally U-shaped bent metal plate. Between the two legs of the housing 10 an insert path 20 for an insert tongue 22 of the safety belt system is formed. The webbing 24 is led through a slot 26 of the insert tongue 22.

A locking bar 30 loaded by a pressure spring 28 is displaceably guided transversely of the insert path 20 by a portion of the housing 10. In its position shown in FIG. 2 it traverses aligning openings of the housing 10 and the insert tongue 22. Between the inner side of the cover 12 and the housing a release button 32 is displaceably guided by a portion of the housing 10. The release button 32 is movable from an unactuated position to an actuated position by a vehicle occupant applying force on the release button 32. The force is a non-inertial force. Said release button is provided with a recess for the passage of the latch or locking bar 30. The release button 32 is biased by a pressure spring 36 into its unactuated position shown in FIG. 2.

Figure 6:
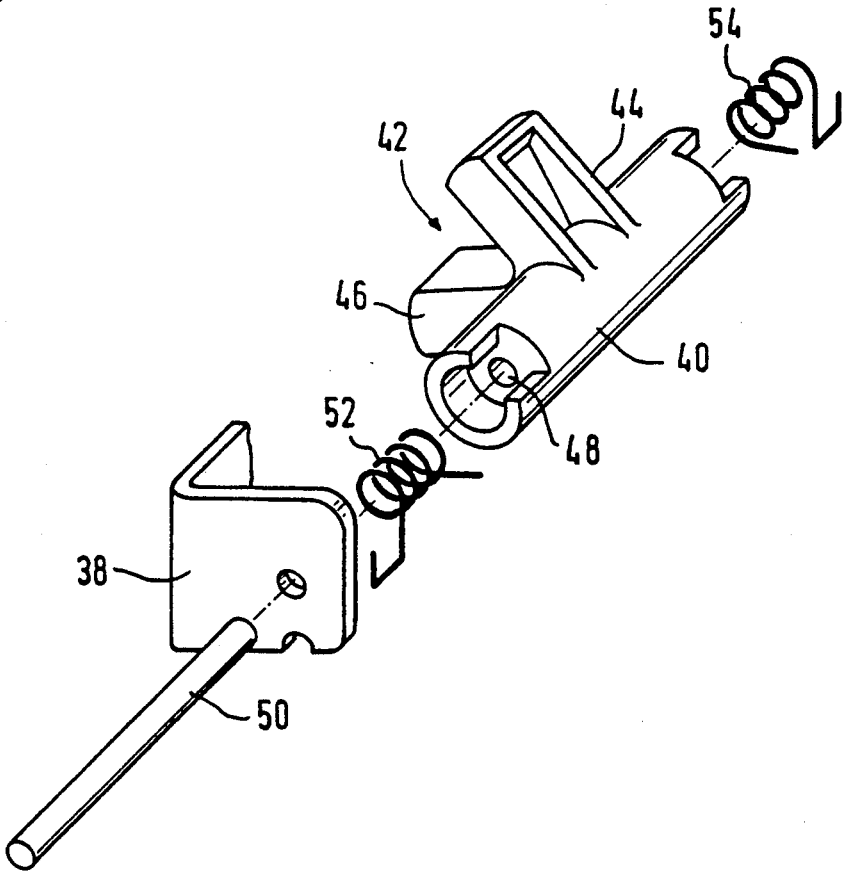
FIG. 6 is an exploded illustration of a two-armed lever and its mounting in the buckle according to FIGS. 2 to 5.

Together with the fitting 16 a U-shaped bearing bracket 38 is secured to the housing 10 by means of a rivet 14. A two-armed lever 42 is pivotally mounted between the two legs of the bearing bracket 38 by means of a cylindrical hub 40 (FIG. 6). The two arms 44, 46 of the two-armed lever 42 are made integrally with the hub 40 and project in V-shaped manner from the latter. The cylindrical hub 40 is provided with a coaxial bearing bore 48 for a bearing pin 50 which is secured in the legs of the bearing bracket 38. The two-armed lever 42 is biased into its rest position shown in FIG. 2 by two torsion springs 52, 54 acting independently of each other. In this rest position the arm 44 comes to bear on an inwardly extending projection 56 of the cover shell 12. The projection 56 acts to stop the lever 42.

Figure 3:
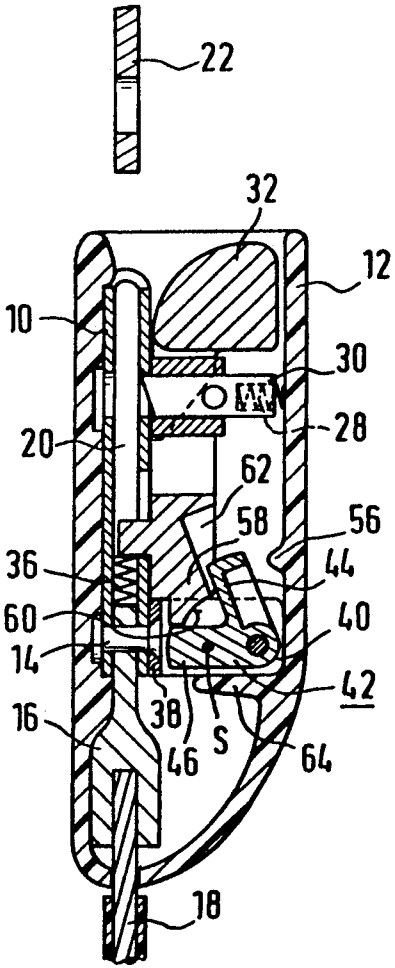
FIG. 3 shows the same buckle with the insert tongue ejected.

The release button 32 is provided at its end disposed in the interior of the cover 12 with a nose 58 which comprises a concavely curved stop face 60. The arm 46 of the lever 42 projects in the rest position thereof (FIG. 2) into the path of movement of the nose 58 of the release button 32. On actuation of the release button 32 by the vehicle occupant, the release button 32 is moved into the interior of the cover 12 to its actuated position, as shown in FIG. 3, the nose 48 striking against the arm 46 of the two-armed lever and pivoting the latter out of its rest position against the spring biasing of the torsion springs 52, 54. The release button 32 is provided directly above the nose 58 with a wedge-shaped recess 62 into which the arm 44 of the lever 42 dips. As soon as the insert tongue 22 is ejected and the pressure on the release button 32 decreases, the latter is pushed by the pressure spring 36 back into its rest position shown in FIG. 2. At the same time, the two-armed lever 42 is pivoted by the action of the torsion springs 52, 54 back into its rest position shown in FIG. 2.

It is thus clear that the two-armed lever 42 on each actuation of the release button 32 is pivoted out of its rest position into a deflected position. The release button 32 compels this pivoting of the lever 42. It is therefore impossible for the lever 42 to become difficult to move or even seize after a long period of use of the buckle.

The bearing bracket 38 and the cylindrical hub 40 ensure a mechanically highly stressable mounting of the two-armed lever 42.

Figure 4:
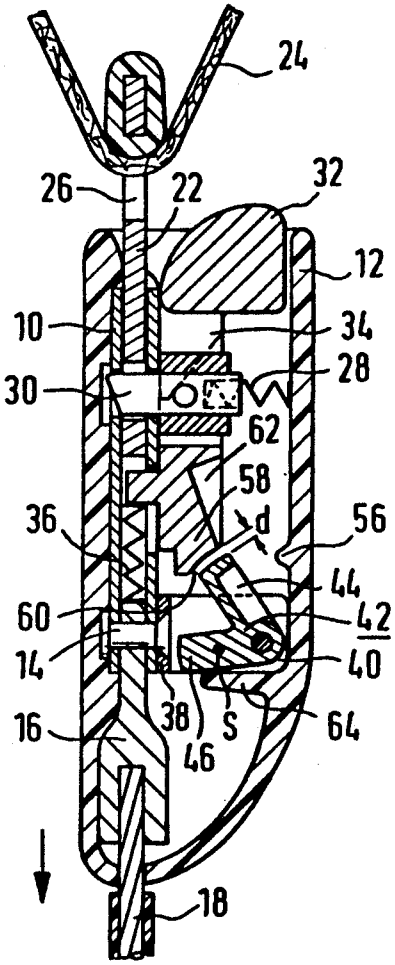
FIG. 4 shows the buckle with inserted and locked insert tongue at the end of a pretensioning stroke.

The buckle described is intended for safety belt systems which are provided with a belt pretensioner which moves the buckle in the direction indicated by an arrow in FIG. 4 towards the vehicle floor, i.e. downwardly. This direction coincides with the actuation direction of the release button 32. At the end of the pretensioning stroke the downward movement of the buckle is abruptly terminated. Particularly when using a pyrotechnical drive, an extremely high deceleration takes place at the end of the stroke. Due to its mass inertia, the release button 32 tends to continue its downward movement. However, it can perform a downward movement only when the inertial forces acting on it are greater than the force with which the spring 36 urges the release button 32 into its unactuated position. The center of gravity of the two-armed lever 42 lies in the arm 46 and is denoted by the letter S. With respect to the pivot axis of the lever 42 the center of gravity is located so that the lever is pivoted anticlockwise under the action of the inertial forces occurring at the end of the pretensioning stroke. However, the pivoting of the lever 42 does not take place until the forces generated by the mass inertia overcome the spring biasing by the torsion springs 52, 54. The torsion springs 52, 54 are so dimensioned that even under a relatively small deceleration of the buckle at the end of the stroke the lever 42 is pivoted out of its rest position into the deflected or rest position shown in FIG. 4 before the release button 32 starts its downward movement. On the deflected position of the lever 42 and before the start of the downward movement of the release button there is a small clearance of for example 1 mm between the concave stop face 60 of the nose 58 of the release button 32 and the opposite convexly curved end face at the end of the arm 44 of the lever 42. It is only when the deceleration further increases that the release button 32 begins its downward movement, then however striking with its nose 58 against the arm 44 of the lever 42 so that its downward movement in the actuating direction is prevented. Thus, the lever 42 blocks the release button 32 from reaching its actuated position. It is apparent that the lever 42 must have reached its deflected position before the downward movement of the release button 32 begins, because otherwise the conditions shown in FIG. 2 apply and the release button 32 can be shifted without obstruction into its actuating position. It is therefore essential to adjust to each other the spring forces of the springs 36, 52 and 54 on the one hand and the masses of the release button and the two-armed lever 42 on the other.

The arched form of the support faces of the nose 58 and the lever arm 44 coming into engagement with each other results in a uniform load distribution so that the lever 42 can also take up high forces introduced via the release button 32. In its deflected position the lever 42 holds its arm 44 at a suitable angular position with respect to the nose 58 of the release button 32 in order to ensure optimum load distribution on the mounting of the lever. To limit the deflected position of the lever 42 a stop wall 64 is integrally formed on the inner side of the cover 12. The stop wall 64 acts to stop the lever 42.

Figure 5:
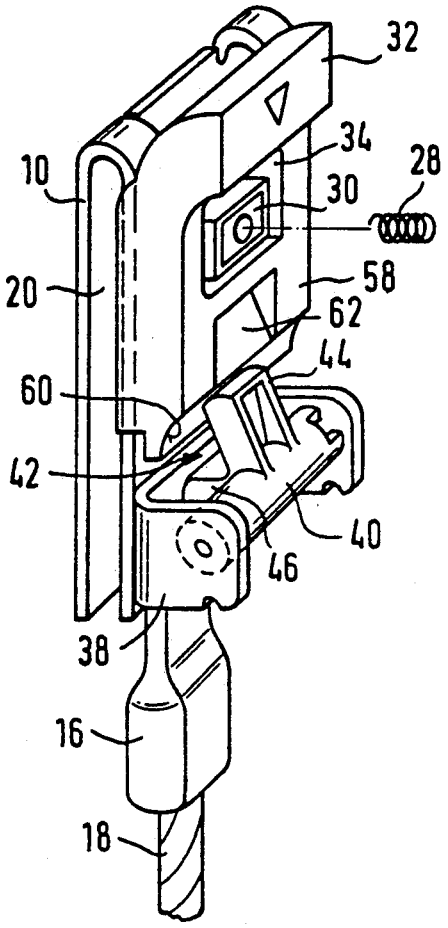
FIG. 5 is a perspective view of the functional components of the buckle.

FIGS. 7 and 8 show two constructional variants of the spring loading of the two-armed lever 42. In the embodiment according to FIG. 7 the torsion springs 52, 54 of the arrangement shown in FIG. 5 are replaced by a helical spring 70 which likewise acts as torsion spring and has two arms 72, 74 extending in the same plane. The cylindrical portion of the spring 70 is secured by means of a rivet 76, a screw or the like to the periphery of the hub 40 of the lever 42. The cylindrical portion of the spring 70 is received in the interior of an arcuate dish 78 which is integrally formed on the hub 40 and over the upper ends of which the arms 72, 74 of the spring 70 extend. Said spring arms engage with their ends in associated recesses 80, 82 in the legs of the bearing bracket 38. This arrangement ensures that the spring 70 is installed with the proper orientation.

In the embodiment shown in FIG. 8 a straight spring wire 90 is used for the spring loading of the lever 42. Said spring wire 90 is held in its center by two lugs 92 forming a slot and integrally formed on the hub 40. The ends of the spring wire 90 engage as in the embodiment of FIG. 7 in associated recesses 80, 82 of the bearing bracket 38.

I claim:

1. A buckle for a safety belt system which includes a belt pretensioner to move said buckle along a pretensioning stroke, said buckle comprising:

a load bearing housing defining an insert path for receiving an insert tongue;

a locking bar movable between a first position in which said locking bar engages the insert tongue to prevent removal of the insert tongue from said housing and a second position in which said locking bar is disengaged from the insert tongue to enable the insert tongue to be removed from said housing;

a release button movable between an unactuated position and an actuated position along a movement path, said release button including means for moving said locking bar from said first position to said second position during movement of said release button from said unactuated position to said actuated position;

a first spring biasing said release button into said unactuated position;

a lever pivotally mounted about a pivot axis for movement between a rest position and an end position; and a second spring biasing said lever into said rest position;

said lever having a center of gravity displaced from said pivot axis, said center of gravity being located such that said lever is pivotable due to inertial force created when said buckle reaches an end of said pretensioning stroke, said lever being pivoted from said rest position to said end position prior to said release button moving from said unactuated position due to the inertial force;

said lever having a first arm and a second arm, said first arm projecting into said movement path of said release button and being engageable by said release button to prevent said release button from reaching said actuated position when said lever is in said end position, said first arm being adjacent to and spaced from said movement path of said release button when said lever is in said rest position, said second arm projecting into said movement path of said release button when said lever is in said rest position; and said release button including means for engaging said second arm and pivoting said lever to said end position during movement of said release button along said movement path due to non-inertial force.

2. The buckle according to claim 1, said lever having a mass, said release button having a mass, said first spring having a first spring force constant, said second spring having a second spring force constant, wherein said mass of said release button, said mass of said lever, said first spring force constant, said second spring force constant and the location of said pivot axis of said lever relative to the location of said center of gravity of said lever when said lever is in said rest position being selected so that pivoting of said lever to said end position due to the inertial force occurs prior to movement of said release button moving from said unactuated position due to the inertial force.

3. The buckle according to claim 1, wherein said first and second arms of said lever are arranged in a V-shaped manner.

4. The buckle according to claim 1, including a U-shaped bearing bracket and a pin, said bracket being mounted on said housing, said bracket having two legs, said pin being mounted between said legs, said lever including a generally cylindrical hub, said pin extending into said hub.

5. The buckle according to claim 4 wherein said second spring is secured to said hub of said lever, said second spring having ends engaging associated recesses of said bracket.

6. The buckle according to claim 1, wherein said first arm of said lever has a free end with a convex end face which corresponds to a concave stop face at an adjacent end of said release button.

7. The buckle according to claim 1, including a third spring biasing said lever into said rest position, said third spring acting independently of said second spring, said second and third springs moving said lever to said rest position after a pretensioning stroke has occurred and after each actuation of said release button.

8. The buckle according to claim 1, wherein said release button having a recess, said first arm being moved into said recess of said release button during movement of said release button to said actuated position due to the non-inertial force.

9. The buckle according to claim 8, wherein said recess of said release button is wedge-shaped.

10. The buckle according to claim 1, further including first and second stops, said lever engaging said first stop when said lever is in said rest position and engaging said second stop when said lever is in said end position.

11. The buckle according to claim 10 further including a cover surrounding said load bearing housing, said first and second stops being integrally formed on said cover.

12. The buckle according to claim 1, wherein the insert tongue, said locking bar and said release button are arranged and formed relative to each other such that at the end of said pretensioning stroke the insert tongue and said release button are temporarily coupled together in mutual force-transmitting relationship.

13. The buckle according to claim 1, wherein said lever is mounted on said housing.

14. A seat belt buckle, said buckle comprising:

housing means for bearing a load, said housing means defining an insert path for receiving a tongue;

lock means for preventing removal of the tongue received by said housing means along said insert path, said lock means including means for engaging the tongue to prevent removal of the tongue from the insert path when said lock means is in a lock position, said lock means being disengaged from the tongue to permit removal of the tongue when said lock means is in an unlocked position;

first guide means for guiding said lock means for movement of said lock means between said lock position and said unlocked position, said first guide means being connected to said housing means;

release means for moving said lock means from said lock position to said unlocked position as said release means is moved from an unactuated position to an actuated position;

second guide means for guiding said release means for movement of said release means between said unactuated position and said actuated position, said second guide means being connected to said housing means;

spring means for biasing said release means into said unactuated position;

blocking means for preventing said release means from reaching said actuated position during movement of said release means toward said actuated position due to inertial force; and support means for supporting said blocking means for pivotable movement of said blocking means about a pivot axis between a rest position and an end position due to inertial force prior to movement of said release means toward said actuated position due to inertial force;

said blocking means including a first arm means for engaging said release means to block further movement of said release means prior to said release means reaching said actuated position when said blocking means is in said end position and during movement of said release means due to inertial force;

said blocking means including a second arm means for engagement with said release means during movement of said release means toward said actuated position due to non-inertial force; and said release means including surface means for engaging said second arm means to pivot said blocking means from said rest position to said end position during movement of said release means to said actuated position due to non-inertial force.

15. A buckle as set forth in claim 14, said release means having a recess, said fist arm means being moved into said recess upon pivoting of said blocking means due to engagement of said second arm means by said surface means of said release means.

16. A buckle as set forth in claim 15, including a first stop means for engaging said blocking means when said blocking means is in said rest position and a second stop means for engaging said blocking means when said blocking means is in said end position.

17. A buckle as set forth in claim 15, said blocking means having a center of gravity spaced away from said pivot axis.

18. A buckle as set forth in claim 15, wherein said release means having a concave surface segment, said first arm means engaging said concave surface segment during blocking of movement of said release means.

* * * * *

UNITED STATES PATENT AND TRADEMARK OFFICE

CERTIFICATE OF CORRECTION

PATENT NO. : 5,213,365

DATED : May 25, 1993

INVENTOR(S) : Artur Fohl

It is certified that error appears in the above-identified patent and that said Letters Patent is hereby corrected as shown below:

Column 8, line 50, change "15" to -- 14 --.

Column 8, line 55, change "15" to -- 14 --.

Column 8, line 58, change "15" to -- 14 --.

Signed and Sealed this

Twenty-fifth Day of January, 1994

*Attest:*

*Attesting Officer*

BRUCE LEHMAN

*Commissioner of Patents and Trademarks*